US006851434B2

(12) United States Patent
Cole et al.

(10) Patent No.: US 6,851,434 B2
(45) Date of Patent: Feb. 8, 2005

(54) COMPOSITION, APPARATUS, AND METHOD OF CONDITIONING SCALE ON A METAL SURFACE

(76) Inventors: John M. Cole, 400 Woods Edge La., White Lake Township, MI (US) 48386; James C. Malloy, 404 W. Saratoga, Ferndale, MI (US) 48220; John F. Pilznienski, 5967 Waverly, Dearborn Heights, MI (US) 48127; William G. Wood, 428 Maincentre, Northville, MI (US) 48167

( * ) Notice: Subject to any disclaimer, the term of this patent is extended or adjusted under 35 U.S.C. 154(b) by 289 days.

(21) Appl. No.: 10/083,067

(22) Filed: Feb. 26, 2002

(65) Prior Publication Data

US 2002/0148484 A1 Oct. 17, 2002

Related U.S. Application Data

(62) Division of application No. 09/469,687, filed on Dec. 22, 1999, now Pat. No. 6,450,183.

(51) Int. Cl.[7] ..... B08B 3/00

(52) U.S. Cl. ..... 134/56 R; 134/94.1; 134/102.1; 134/103.2; 134/105; 134/122 R; 15/302; 15/309.1

(58) Field of Search ..... 134/56 R, 94.1, 134/102.1, 103.2, 105, 122 R, 15, 2, 30, 37; 15/302, 309.1

(56) References Cited

U.S. PATENT DOCUMENTS

| | | | | |
|---|---|---|---|---|
| 3,084,868 A | | 4/1963 | Faler et al. | 239/102 |
| 3,126,301 A | | 3/1964 | Faler | 134/29 |
| 3,174,491 A | * | 3/1965 | Faler | 134/102.1 |
| 3,617,039 A | | 11/1971 | Hiroshima et al. | 266/3 R |
| 3,715,236 A | | 2/1973 | Fukui et al. | 134/2 |
| 4,317,685 A | | 3/1982 | Ahuja et al. | 134/2 |
| 4,361,444 A | * | 11/1982 | McClanahan et al. | 134/3 |
| 5,272,798 A | | 12/1993 | Cole et al. | 29/81.08 |
| 5,361,788 A | * | 11/1994 | Cole et al. | 134/64 R |
| 5,377,398 A | | 1/1995 | Bessey | 29/81.07 |
| 5,505,786 A | * | 4/1996 | Cole et al. | 134/2 |
| 5,800,694 A | | 9/1998 | Starcevic et al. | 205/705 |

FOREIGN PATENT DOCUMENTS

| | | | |
|---|---|---|---|
| DE | 43 00 660 A1 | | 7/1994 |
| EP | 0 601 991 A1 | | 12/1993 |
| EP | 0 744 233 A2 | | 5/1996 |
| GB | 217831 | | 10/1923 |
| JP | 58-75403 | | 4/1983 |
| JP | 6-143142 | * | 5/1994 |
| JP | 10121298 | | 5/1998 |
| JP | 11246982 | | 9/1999 |

OTHER PUBLICATIONS

"Disk model of the dynamic Leidenfrost phenomenon", Abstract submitted for the DFD96 Meeting of The American Physical Society, Martin Rein, Aug. 5, 1996.

"Miracle Mongers and their Methods", Chapter 7, pp. 122–124, Harry Houdini, pub. 1920 by E. P. Dutton.

* cited by examiner

*Primary Examiner*—M. Kornakov
(74) *Attorney, Agent, or Firm*—Patrick J. Daugherty; Driggs, Lucas, Brubaker & Hogg Co., L.P.A.

(57) ABSTRACT

A composition and apparatus and method for aqueous spray conditioning of scale on metal surfaces. An aqueous solution having a base composition of an alkali metal hydroxide is used. The aqueous solution may contain additives to improve the performance of the salt. In one embodiment, the solution is used to condition the scale on a strip of stainless steel. The strip of steel is at a temperature between the melting point of the alkali metal hydroxide in anhydrous form and a temperature at which the Leidenfrost effect appears. One or more nozzles is provided to spray the solution, and the heated strip is passed by the nozzle or nozzles where the solution is sprayed on the surface or surfaces of the strip that have the scale or oxide. The invention also includes the apparatus and control thereof for the spraying of the solution.

22 Claims, 3 Drawing Sheets

COMPOSITION, APPARATUS, AND METHOD OF CONDITIONING SCALE ON A METAL SURFACE

CROSS REFERENCE TO RELATED APPLICATION

This application is a divisional of application Ser. No. 09/469,687, filed Dec. 22, 1999 now is U.S. Pat. No. 6,450,183.

FIELD OF THE INVENTION

This invention relates generally to conditioning of oxide or scale on a metal surface; more particularly on a strip of metal, and yet more particularly, to conditioning of oxide surfaces or scale on a stainless steel strip. Stainless steels are ferrous alloys containing more that about 10% chromium for the purpose of enhancing corrosion and oxidation resistance. Some stainless steels also contain nickel, molybdenum, silicon, manganese, aluminum, carbide formers and other elements. This invention is also applicable to families of alloys including superalloys where nickel is the predominant element, titanium alloys and cobalt alloys. In even more particular aspects, this invention relates to aqueous spray conditioning.

BACKGROUND OF THE INVENTION

Descaling of metal strip, especially stainless steel strip, has taken many forms in the past. The simplest technique involves only the pickling of the strip in mineral acid such as sulfuric acid, hydrochloric acid, hydrofluoric acid, nitric acid, or mixtures thereof. This may work with some grades of stainless steel with very light scale, however, in most cases more is needed than just an acid pickle. In those cases, various compositions and techniques have been developed to condition the scale before acid pickling. Typical compositions for scale conditioning include mixtures of alkali metal hydroxides and alkali metal nitrates with various other additives, such as alkali halides, carbonates, and/or other oxidizing agents. These are often referred to as descaling or scale conditioning salts. A conventional technique for using such compositions is in the fused anhydrous state in a pot at elevated temperatures, e.g. 800° F. to 1000° F., through which the strip is passed, followed by an acid pickle. While this works well in many cases, nevertheless there are certain drawbacks to this technique in some instances. For example, the bath has to be maintained at elevated temperatures, which may be energy intensive. Also, the fused caustic baths require submerged rolls which may be difficult to maintain, and can cause marring of the surface of the strip being descaled. Additionally, there is the issue of drag-out of the fused composition, i.e. as the strip exits from the pot of fused composition, it carries a certain amount of the fused composition with it, especially at high strip speeds. Furthermore, fused bath compositions are limited to compounds that have long term stability at elevated temperatures.

Other techniques for descaling are disclosed in commonly assigned U.S. Pat. No. 3,126,301, issued Mar. 24, 1964, entitled "Molten Salt Spray Process for Descaling Stainless Steel" and U.S. Pat. No. 5,272,798, issued Dec. 28, 1993, entitled "Method and Apparatus for Descaling Metal Strip". These patents disclose methods and structures for spraying fused caustic-containing compositions onto a moving strip of steel to condition the scale, after which the scale is pickled off. These offer several advantages, in some instances, over the technique of using a pot of fused material. However, they too have some drawbacks in some instances. They require high temperature nozzles, and the composition must be maintained at elevated temperatures, e.g. 800° F. to 1000° F.

Thus, there is a need for a relatively inexpensive, low temperature, and efficient technique for conditioning scale on metal surfaces, especially on stainless steel strip, or the like.

SUMMARY OF THE INVENTION

According to the present invention, a composition and apparatus and method of using the composition for aqueous spray descaling or conditioning of scale or oxide on metal surfaces is provided, especially stainless steel strip or the like, in one embodiment, although it can be used to descale or condition oxide or scale on other work pieces such as metal bar, or even discrete objects. An aqueous solution having a base composition of an alkali metal hydroxide, such as sodium hydroxide, potassium hydroxide, or a mixture of alkali metal hydroxides such as sodium hydroxide and potassium hydroxide is used. The aqueous solution may contain certain additives to improve the descaling performance of the salt. In one embodiment, the solution is used to condition the scale or surface oxide on a strip of stainless steel. The strip of steel is at a temperature between the melting point of the alkali metal hydroxide in anhydrous form and a temperature at which the Leidenfrost effect appears. One or more nozzles is provided to spray the solution, and the heated strip is passed by the nozzle or nozzles where the solution is sprayed on the surface or surfaces of the strip that have the scale or oxide. The invention also includes the apparatus and control thereof for the spraying of the solution.

DESCRIPTION OF THE PREFERRED EMBODIMENTS

Figure 1:
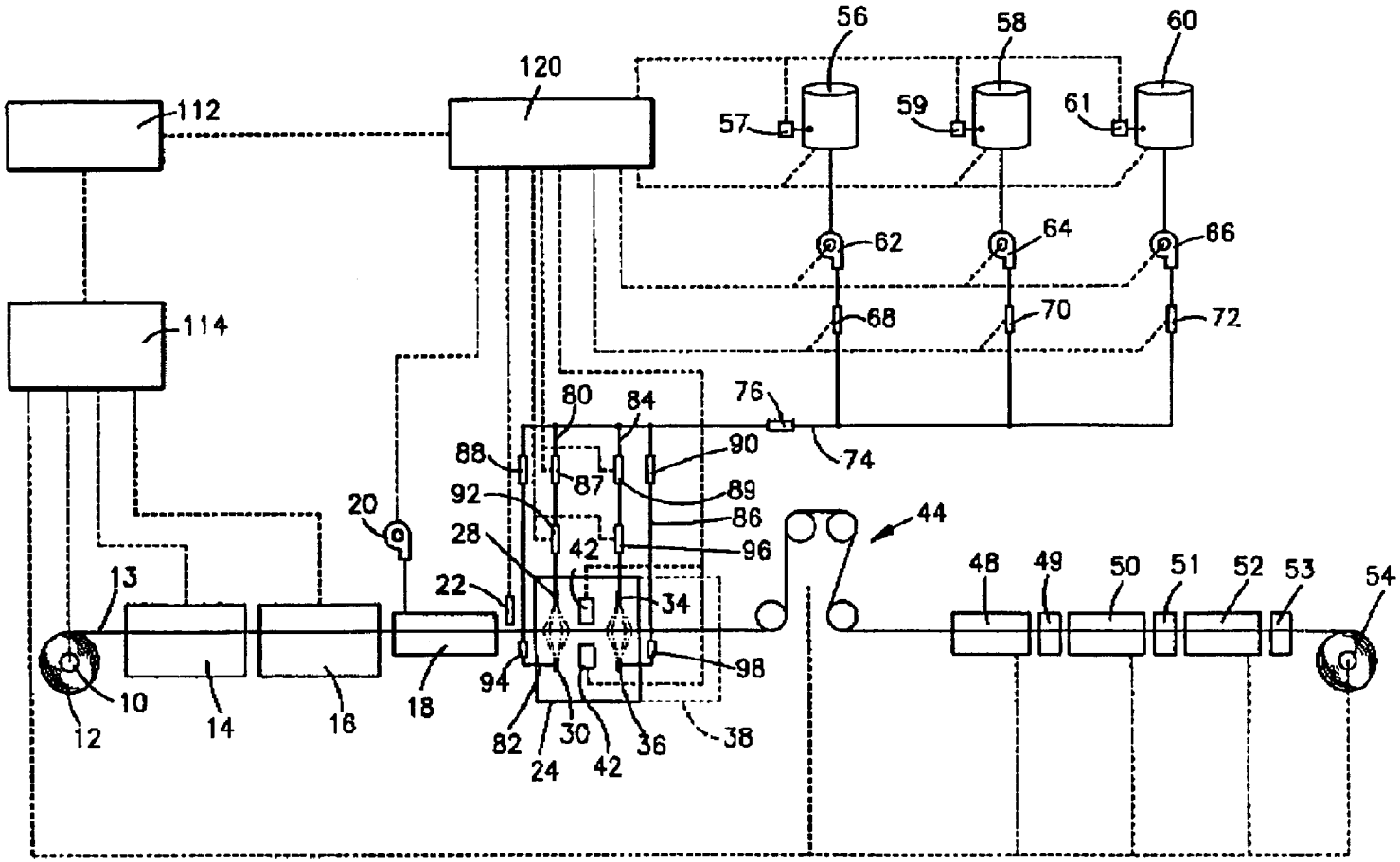
FIG. 1 is a diagrammatic view of an annealing line incorporating a scale conditioning section according to the present invention.

Referring now to the drawings, and for the present to FIG. 1, a somewhat diagrammatic representation of an anneal and pickle line incorporating a scale conditioning and pickling unit according to this invention is shown. It is to be understood that annealing and pickling lines incorporating scale-conditioning units are known in the art. However, the present invention utilizes improved scale conditioning techniques in conjunction with the anneal and pickle line.

The line has an uncoiler 10 adapted to support and uncoil a coil of steel 12, which coil of steel is to be annealed and pickled to remove the scale formed during annealing. The uncoiler 10 uncoils the steel from the coil 12 as a strip of steel 13 that passes through a pre-heat furnace 14 and an annealing furnace 16. The strip then goes into a cooling section 18 which includes at least one variable speed fan 20. Other means of achieving variable cooling may be employed such as flow control dampers, vents, or the like (not shown). The fan 20 is to cool the strip 13 to the desired temperature as will be described presently. Also, more than one fan 20 could be employed to cool the strip of steel 13 The temperature of the strip 13 as it emerges from the cooling section 18 is measured by a temperature-sensing device, such as an infrared temperature sensor 22.

From the cooling section 18 the strip 13 enters a scale conditioning section 24. In this section the scale conditioning solution is sprayed onto the upper and lower surfaces of the strip 13. The solution and the manner of spraying, as well as other parameters will be described presently. The scale conditioning section 24 includes a first or primary set of nozzles including a set of upper nozzles, one of which is shown at 28, to spray the top surface of the strip 13, and a set of lower nozzles, one of which is shown at 30, to spray the lower surface of the strip 13. A second or backup set of spray nozzles including upper nozzles, one of which is shown at 34, and lower nozzles, one of which is shown at 36, may optionally be added to insure coverage if necessary, as will be described presently. (Of course, only one set of nozzles may be needed in some cases, or more than two sets of nozzles may be required in some cases, depending on the speed and width of the strip 13 and other factors.) The nozzles 28, 30, 34, and 36 are of a type that can receive liquid and spray the liquid as very fine atomized droplets onto the strip of steel 13. The nozzles can be Air Atomizing type VAU as supplied by Spraying Systems Co. While an air atomizing nozzle is described, other spray forming techniques that provide adequate atomization/small droplet size, such as high pressure hydraulic nozzles, may also be used effectively. Specialized techniques such as electrostatic deposition may be used to enhance transfer efficiency. A rinse section 38, shown in dotted outline, is provided adjacent the spray section 24. This rinse can optionally be either of the spray type or immersion type. In the immersion type, rinse is carried out by passing the strip under a rubber immersion roll submerged in a water rinsing tank, and in the spray type, rinsing is carried out by the strip passing through an array of water spray nozzles being supplied with fresh water, or by a pump from a collection sump located below the spray area. A surface analyzer 42 is optionally provided adjacent the nozzles 28 that will monitor the surfaces of the strip to detect lack of conditioning. This analyzer 42 may be an infrared linescan system or other machine vision system. One suitable infrared system is Landscan supplied by Lan Instruments International Inc. The analyzer provides input to the line dynamics operating system that will be described presently Following the rinse section, the strip is guided by a set of conventional tracking and bridle rolls 44. This set of rolls 44 will keep the strip on track and maintain proper tension in the strip.

The strip of steel 13 typically then goes to an acid pickling section. Acid pickling usually includes one or more acid tanks, although acid spray could be used. Multiple acid pickles may be required on some grades of stainless steel, as illustrated at 48, 50 and 52. Rinse tanks 49, 51 and 53 are provided following pickle tanks 48, 50 and 52, respectively. Typically, the tank 48 contains sulfuric acid, tanks 50 and 52 contain either a mixture of nitric acid and hydrofluoric acid or nitric acid. One or more of these may be used on any given strip 13 of stainless steel depending on many factors, including the composition of the steel, the thickness of the oxide, and other factors known in the art. In addition, other acids and mixtures of acids may be used, which also is well known in the art.

Following emergence of the strip 13 from the acid pickle and rinse, the strip is recoiled on recoiler 54. At this point, all of the scale conditioning and pickling has been completed.

The liquid scale conditioning solution sprayed on the strip 13 by the nozzles 28, 30, 34, and 36 is supplied thereto from one or more liquid product storage vessels 56, 58, and 60 having temperature sensors 57, 59 and 61, respectively, The reason for several vessels is to store different solutions that may be required or desirable for different grades of steel and/or storing additives to the base solution that can be mixed in-line to provide the desired composition, all as will be described presently. The vessels 56, 58, and 60 are provided with discharge pumps 62, 64, and 66, respectively, to pump liquid from their respective storage vessel. At the output side of the pumps 62, 64, and 66 are flow controllers 68, 70 and 72, respectively. (It is to be understood that it is possible to use metering-type variable flow pumps 62, 64, and 66 and thus combine the metering and flow regulating functions in a single unit, eliminating the need for flow controllers, although flow meters may be desired.) From the flow controllers 68, 70, and 72, the liquid is delivered to nozzle supply line 74 which contains an in-line mixer 76 to assure complete mixing of product delivered from two or more storage vessels 56, 58, and 60. Lines 80, 82, 84 and 86 supply the nozzles 28, 30, 34 and 36, respectively, with the liquid product that is to be sprayed on the strip 13, and flow sensors 87, 88, 89 and 90 and metering valves 92, 94, 96 and 98 are provided in the lines 80, 82, 84 and 86, respectively, to monitor and control the flow to each spray nozzle 28, 30, 34 and 36, respectively.

Another way of utilizing multiple storage vessels is to use one vessel with a concentrated feedstock that might not allow some additives to be in solution with it, and a second vessel containing the additive(s). The first vessel would feed a first array of nozzles, and the second vessel would feed a second, downstream array of nozzles. This would be used where in-line mixing would not be feasible or desirable because of solubility limitations, ion-exchange, precipitation, or other untoward results of in-line mixing of concentrated solutions, e.g. nozzle blockages, filter blinding, etc.

The system controls include a line dynamics operating system 112 which receives operating line system inputs, and outputs line variables 114 to operate the annealing line, as will be described presently. There is also provided a scale conditioning process control system 120 which receives as control variables outputs from the line dynamics operating system 112.

Before describing the operation of the line in detail, a description of the method of the present invention will be given. According to one embodiment of this invention, an aqueous solution containing an alkali metal hydroxide is sprayed in the form of droplets onto a strip of stainless steel or other metal, with the strip being held at a temperature above the melting point of the essentially anhydrous form of the material in solution and below that at which the Leidenfrost effect appears. As used herein, the term "essentially anhydrous form of the material" means after the water of solution is evaporated, even though there may be some water of hydration still present in the material. As used herein, the term "Leidenfrost effect on the strip" is a mottled or speckled surface appearance of the strip, which reveals patches, or spots of incomplete scale conditioning. This is believed to be due to the Leidenfrost effect on the aqueous solution of chemicals if the strip is above what is known as the Leidenfrost temperature or Leidenfrost point of the solution being sprayed. When the strip is above the Leidenfrost temperature of the solution being sprayed, a thin film of the sprayed liquid is converted to a vapor phase barrier between the metal surface and the droplet, preventing the droplet from contacting the surface of the strip and depositing the chemicals on the metal surface upon evaporation of the liquid. The Leidenfrost effect is well known and described in many publications. Two such publications are: "Disk Model of the Dynamic Leidenfrost Phenomenon" (Martin Rein at DFD96 meeting of American Physical Society) and "Miracle Mongers and Their Methods" (pages 122–124 by Harry Houdini, published 1920 by E. P Dutton).

Figures 2, 3:
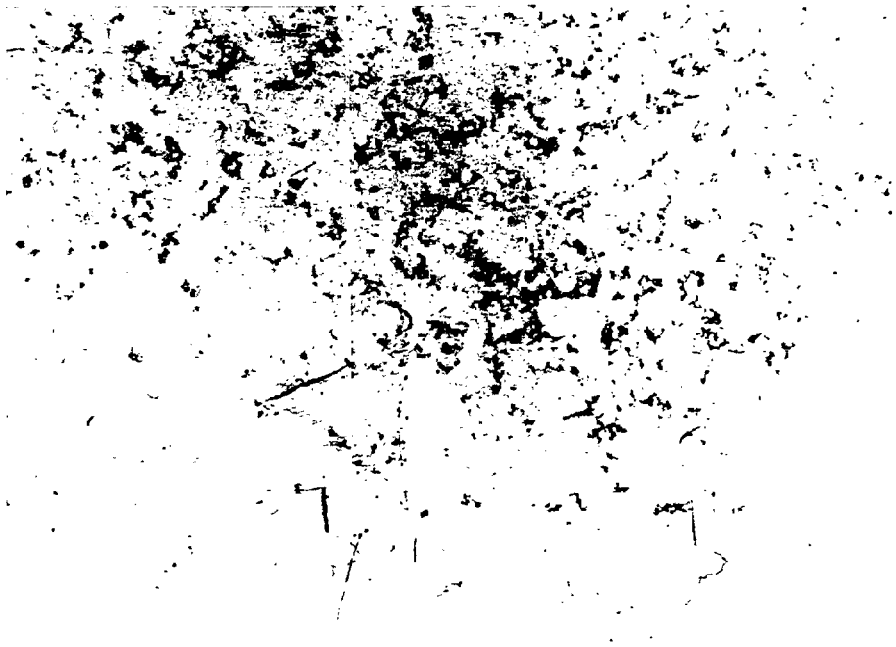
FIG. 2 is a photograph of the surface of a sheet of stainless steel treated and pickled according to this invention.
FIGS. 3–5 are photographs of surfaces of sheets of stainless steel showing the Leidenfrost effect after treatment at a temperature above that of the present invention and pickled.
Figure 4:
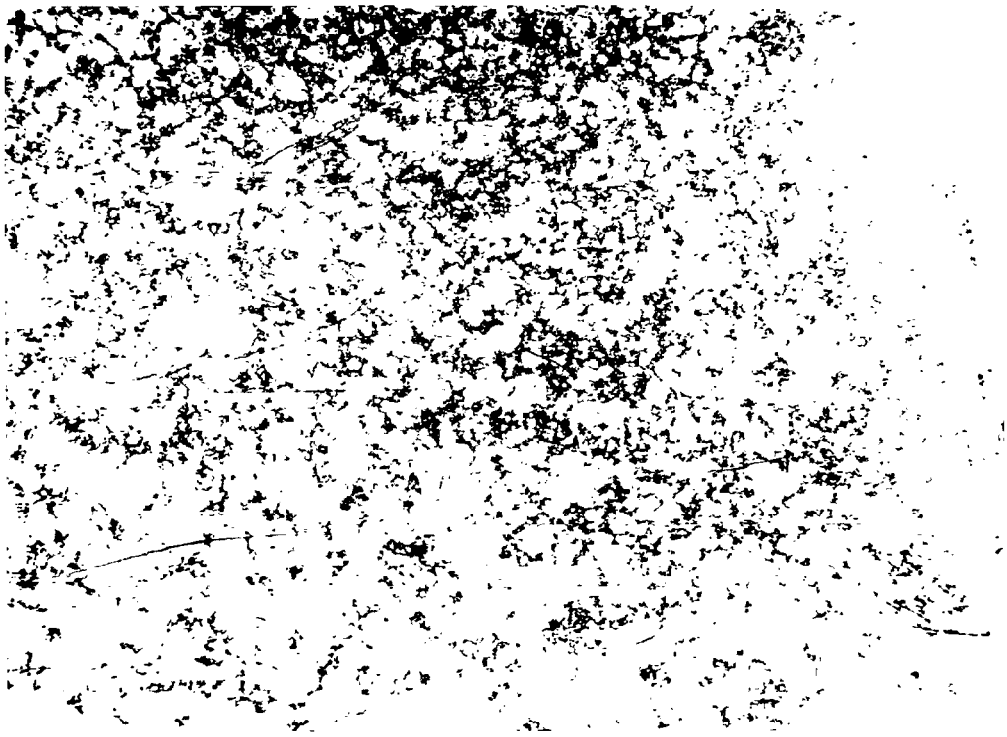
Figure 5:
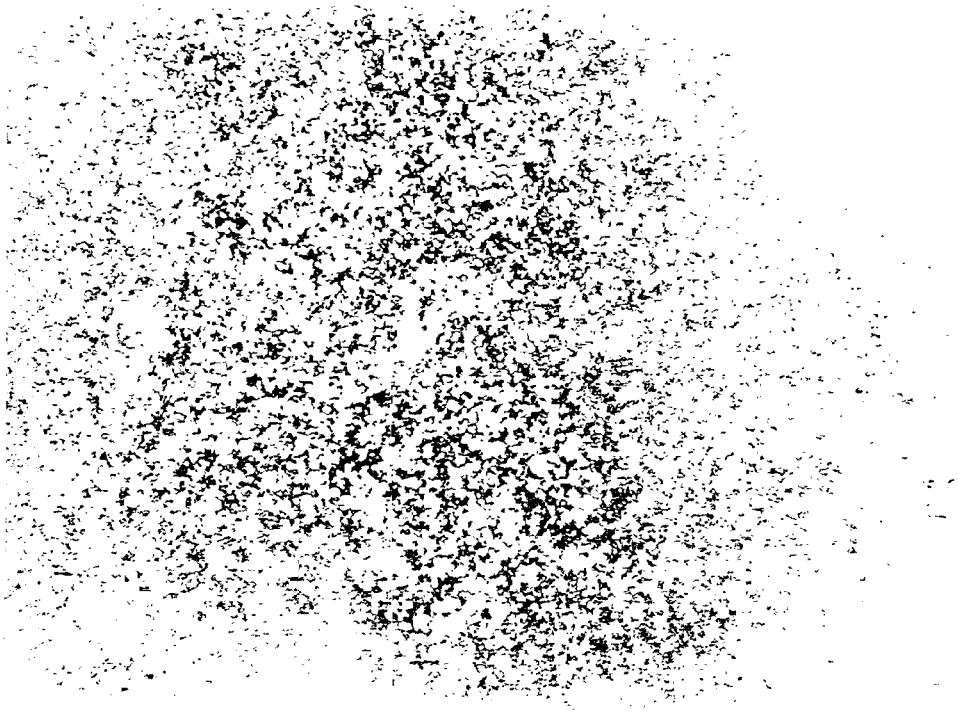

FIG. 2 is a photograph of the surface of a type 304 stainless steel sample that does not show the Leidenfrost effect after a treatment according to this invention, which treatment will be described presently; FIGS. 3–5 are photographs of the surfaces of type 304 stainless steel samples that show the Leidenfrost effect to various degrees after scale conditioning (FIG. 5 being the worst) outside the scope of the present invention and pickling, also as will be described presently. It should be noted that with respect to FIGS. 3–5, there are areas where the scale conditioning is complete, i.e. the white or gray areas, as well as areas where there is incomplete scale conditioning, i.e. the dark areas. This indicates that some of the droplets exhibited the Leidenfrost effect, i.e. where the dark spots appear, and some of the drops of solution either did not experience or overcame the Leidenfrost effect and, thus, were effective for scale conditioning, i.e. the white or bright areas. Thus, as used herein, the term "a temperature below which the Leidenfrost effect appears" refers to a temperature at which no appreciable scale in the form of dark spots exists after scale conditioning according to this invention and subsequent pickling. The surface as shown in FIG. 2 is an example of a temperature at which no Liedenfrost effect is present, and FIGS. 3–5 are examples of temperatures at which the Leidenfrost effect is present.

The samples of FIGS. 2–5 as well as other samples were prepared and treated as follows: The samples were 4 inch×6 inch panels of 0.025 inch gage type 304 stainless steel. Each sample was heated to a temperature of about 1950° F. in air and then removed and clamped in a test fixture. The samples were cooled to a predetermined temperature as measured by a contact thermocouple. The samples were then sprayed with an aqueous alkali hydroxide-containing solution, rinsed with water and then acid pickled. Table I below sets out the values for the variables used for the different samples and the descaling results.

TABLE I

| | Temperature | | | | | | | | |
|---|---|---|---|---|---|---|---|---|---|
| Concentration | 400° F. | 450° F. | 500° F. | 550° F. | 600° F. | 650° F. | 700° F. | 750° F. | 800° F. |
| 12.5 w % | P/N | G/M | G/S | — | — | — | — | — | — |
| 23.5 w % | P/N | E/L | E/L | G/S | — | — | — | — | — |
| 35 w % | P/N | E/N | E/N | E/L | E/M | G/S | — | — | — |
| 47 w % | P/N | E/N | E/N | E/N | E/L | G/L | G/M | G/S | — |
| 60 w % | P/N | G/N | E/N | — | — | — | G/N | G/L | G/S |

Ratings Key
First letter = conditioning
E = excellent
G = good
F = fair
P = poor
Second letter = degree of Leidenfrost effect observed
N = no Leidenfrost
L = light Leidenfrost
M = moderate Leidenfrost
S = severe Leidenfrost
Notes:
All tests performed at 100 fpm transfer rate.
All tests performed with 304 stainless steel, 0.025 inch gage
All tests performed with flow rates adjusted to deposit same solids content
12.5 w % @ 117 mls/min flow rate
23.5 w % @ 60 mls/min flow rate
35 w % @ 40 mls/min flow rate
47 w % @ 30 mls/min flow rate
60 w % @ mls/min flow rate
Dwell time before water rinsing was ca. 10 seconds
All samples were pickled after spray conditioning and water rinsing:

TABLE I-continued

| | Temperature | | | | | | | | |
|---|---|---|---|---|---|---|---|---|---|
| Concentration | 400° F. | 450° F. | 500° F. | 550° F. | 600° F. | 650° F. | 700° F. | 750° F. | 800° F. |

1) 10 v % sulfuric acid @ 160 F. for 10 seconds
2) 8 % nitric + 1.5% hydrofluoric acids @ 130 F. for 10 seconds
Feedstocks for all tests were sodium hydroxide/potassium hydroxide eute.

From Table I above, it can be seen that a spray of an aqueous alkali hydroxide-containing solution if sprayed onto a stainless steel sample at a temperature above the melting point of the composition in solution i.e., in the case of the eutectic NaOH/KOH salt about 450° F. or greater, and below the temperature at which the Leidenfrost effect appears, even with a contact time of just a few seconds results in acceptable conditioning of the steel surface.

There are several variables that affect the end product. For example, the concentration of the composition in the aqueous solution should be from about 15% to about 65% by weight. With less than about 15% composition, the energy required to evaporate the large amount of water consumes most of the sensible heat available in the hot strip—especially on thinner gage materials, leaving little residual heat to accomplish the required fusion of the deposited salts and to carry out the scale conditioning reaction. With more than about 65%, difficulties arise in the manufacture, transportation, storage, and delivery of the very concentrated solution. Heating and insulating of storage tanks, elaborate heat tracing of piping, recirculating fluid flow paths, etc., must all be utilized because of the elevated temperatures required to maintain the chemicals in solution and prevent precipitation or crystallization. Additionally, high alloy materials must be used for tankage, piping and nozzles because of the concomitant corrosion problems that will occur. Supplemental energy usage for maintaining the elevated storage temperatures may also be undesirable. As the concentration of the salt in solution increases, the upper temperature that can be used without encountering Leidenfrost effect increases to about 700° F. However, with more than about 40% solids, it becomes more difficult to include additions that will be described presently. A preferred concentration is from about 15% to about 50% by weight, a more preferred concentration is from about 35% to about 45%, and a most preferred concentration is about 40% by weight.

The mechanism of conditioning is believed to be comparable to that of conventional molten oxidizing baths wherein the metal oxide is converted to a higher oxidation state that is partially dissolved in the salt and subsequent water rinse while the remainder is thus rendered more readily removable by acid pickling. The conditioning in the present invention occurs as the sprayed solution is heated by proximity of contact with the metal strip and the water is evaporated and the salts are melted by the residual heat in the strip and react with the oxide on the strip surface rapidly, within seconds. Although the aqueous solution may not contain any oxidizing agents, the salt film will have an oxidizing effect on the surface oxides and thereby convert them to the desired higher oxidation state. This occurs apparently due to the absorption of atmospheric oxygen by the aqueous spray and/or the diffusion of atmospheric oxygen through the molten salt film. In the preferred embodiment, the salt will contain small quantities of oxidizer or compounds, such as permanganates, which seem to catalyze the oxidation reaction.

This means of application of conditioning salt to the metal surface is unique and provides the unexpected benefit mentioned above. In addition, an important benefit is the ability to utilize compositions that cannot be used effectively in conventional anhydrous molten salt baths because the mass of material surrounding the surface prevents atmospheric oxygen diffusion. The solution can also utilize additives that may be unstable at typical anhydrous molten salt bath temperatures. Furthermore, this invention eliminates the presence of reaction products in the applied salt and thus allows complete control of the chemistry of the salt at the metal surface. Finally, the quantity of salt consumed can be controlled to the proper amount. With immersion systems, salt consumption is largely dictated by the quantity of salt that adheres to the surface of the metal as it is withdrawn from the molten bath.

In some cases, it may be desirable to use a different salt chemistry when different metals are treated. This can be accommodated with the instant invention quickly and efficiently while it is impractical with immersion systems because of the large quantity of material in the molten salt bath.

There are several different compositions that can be used to effect descaling according to this invention. The preferred base composition is a eutectic of sodium hydroxide (NaOH) and potassium hydroxide (KOH) (42% sodium hydroxide and 58% potassium hydroxide). This is a low melting composition (338° F.) and when the water of solution is evaporated, it is effective to perform scale conditioning. Other materials may be added to the solution to modify the properties of either the solution or the composition Table II below gives certain additives that have beneficial effects, detrimental effects, or no (neutral) effects compared to the base solution.

Scale Conditioning Effect of Various Compounds and Additives

| Compound Tested | Performance When Used as an Additive to Base Descaling Formulation | | | Performance When Used as Sole Descaling Compound | |
|---|---|---|---|---|---|
| | Detrimental | Neutral | Beneficial | Ineffective | Effective |
| acetate, sodium | ✓✓✓ | | | • | • |
| aluminate, sodium | ✓✓ | | | • | • |
| bisulfate, sodium | • | • | • | ✓ | |
| carbonate, sodium | • | • | • | ✓ | |
| carbonate, potassium | | | ✓ | ✓ | |
| chlorate, potassium | | | ✓ | • | • |
| chloride, sodium | ✓ | | | • | • |
| chloride, potassium | | ✓ | | • | • |
| fluoride, potassium | ✓✓✓ | | | • | • |
| formate, sodium | ✓✓ | | | ✓ | |
| gluconate, sodium | ✓✓✓ | | | • | • |
| metaborate, potassium | | ✓ | | • | • |
| metasilicate, sodium | • | • | • | ✓ | |
| molybdate, sodium | ✓ | | | • | • |
| nitrate, sodium | | | ✓ | ✓ | |
| nitrite, sodium | ✓ | | | ✓ | |
| perborate, sodium | | ✓ | | • | • |
| perchlorate, potassium | | ✓ | | • | • |
| permanganate, sodium* | | | ✓✓✓ | • | • |
| permanganate, potassium* | | | ✓✓✓ | • | • |
| phosphate, sodium acid pyro | • | • | • | ✓ | |
| phosphate, mono sodium | • | • | • | ✓ | |
| phosphate, di sodium | • | • | • | • | • |
| phosphate, tri sodium | ✓ | | | • | • |
| sucrose | ✓✓✓ | | | • | • |
| sulfate, sodium | ✓✓ | | | • | • |
| sulfite, sodium | ✓ | | | • | • |
| tetraborate, sodium | ✓✓ | | | • | • |
| thiocyanate, potassium | ✓✓ | | | • | • |
| thiosulfate, sodium | ✓✓ | | | • | • |
| tungstate, sodium | | ✓ | | • | • |
| vanadate, sodium | | ✓ | | • | • |

KEYS:
✓ slight
✓✓ pronounced
✓✓✓ extreme
• not tested due to precipitaion, low solubility, incomparibility or other physical/chemical considerations
*forms alkaline manganate when added to the alkaline base descaling formulation It should be noted that while either a sodium or potassium cation is present in an additive or sole descaling compound, the descaling effect is primarily dependent upon the particular anion present. Thus, a composition will work about as effectively with one cation as with the other if other factors, such as solubility and compatibility, are equal. For example, Table II shows sodium nitrate being effective, thus, potassium nitrate would give comparable results, but is much less soluble in the base composition. In some cases, the cation of the additive or compound tested was dictated by availability.

The compounds or additives listed in Table II were tested on 4"×6" panels of 0.027 gage type 316 stainless steel prepared and treated as described earlier for the samples of FIGS. 2–5 and Table I. Those compounds evaluated as sole descaling agents were tested as saturated aqueous solutions, up to a maximum concentration of 40 weight percent for highly soluble compounds. Those compounds evaluated as additives were generally formulated at 5 weight percent in a solution containing 35 weight percent of the sodium hydroxide/potassium hydroxide eutectic mixture, i.e., 12.5% of the total 40% solids. In some instances, where the additives were known from literature references or determined from preliminary testing to have very limited solubility in water or caustic alkali solutions, the additive was incorporated at only 1% of the solids content. This was the case, for example, with potassium chlorate, potassium perchlorate, and potassium permanganate. Thus, these additives can be added in an effective amount up to about 1%. Also, upon first mixing or upon standing overnight, some of the additives, for example, sodium chloride, sodium nitrate, and sodium sulfate, proved to be incompletely soluble at the formulated percentages, requiring filtration or decantation of the clear liquid for testing. Note particularly that disodium phosphate was not tested for descaling ability, as the formulations solidified, probably due to massive hydrated crystals.

Performance of the compounds used as sole descaling agents was easy to judge visually in that there was no effect, or practically no effect, on the original deep blue oxide scale with any of the compounds tested, including those that were effective as additives. The ineffectiveness of conditioning was confirmed by subsequent pickling in sulfuric acid followed by nitric plus hydrofluoric acids, as described earlier for the samples of FIGS. 2–5 and Table I, after which the original scale was present in unchanged form.

Performance of the additives was judged by comparison with the effects of a 40% solution of the NaOH/KOH eutectic, which exhibited good descaling behavior under the chosen test conditions (i.e., spraying at a flow rate of 35 mL/min. 500° F. panel temperature, and 100 f.p.m. transfer rate).

Evaluation criteria included appearance of the conditioned oxide with regard, e.g., to color, opacity, and uniformity, ease of removal of the conditioned oxide by rinsing, wiping or subsequent acid pickling, and final appearance of the descaled metal surface with regard, e.g., to color, brightness, uniformity, and freedom from residual oxide. It is to be understood that these several criteria can vary independently in degree and direction one from another, so that there is a certain subjective element to the quantitative assignment of detrimental or beneficial effects of the additives, as listed in Table II. A neutral rating, of course, indicates that there was no discernible difference from the performance of 40% NaOH/KOH eutectic solution.

Those additives exhibiting a severe detrimental effect generally inhibited the descaling completely, as occurred with sodium gluconate, or nearly completely, as occurred with sodium acetate and sucrose. As these three materials are organic in nature, they may exert a reducing action that prevents the proper oxidation and conditioning of the scale. Potassium fluoride was deemed highly detrimental for causing a unique, spotty conditioned oxide that resulted in a spottily etched metal surface following acid pickling. The remaining detrimental additives exhibited more or less non-uniformity or inhibition of the conditioning effect. In the more pronounced instances, this resulted in some scale being left on the metal even following acid pickling. In the milder instances, such residual scale was confined to the slightly cooler edges of the panels, suggesting an undesirable narrowing of the effective temperature range.

The beneficial additives resulted in uniformly thinner scales as evidenced primarily by a light-colored, nearly transparent, greenish-gold conditioned oxide which yielded a bright, clean metal surface following pickling in sulfuric acid alone. By way of comparison, the 40% NaOH/KOH eutectic solution yielded a duller, apparently thicker, brownish conditioned oxide that required both sulfuric acid and nitric plus hydrofluoric acid pickling to yield a completely clean metal surface. The beneficial effects were most pronounced with sodium or potassium permanganate.

Turning again to FIG. 1, the operation of the scale conditioning system according to this invention is as follows:

The temperatures of the preheat furnace 14 and the annealing furnace 16 and the speed of the strip 13 are controlled by the line dynamics operating system 112. The operators of the line enter the variables, such as strip material, strip gauge, strip width, and any other special processing information, into the line dynamics operating system 112 which then determines the annealing schedule for the particular coil of steel being annealed in a conventional manner, as is well known in the art. This results in the strip of steel 13 emerging from the annealing furnace 16 and cooler 18 at a given temperature and speed. The line dynamics operating system 112 also inputs the variable information such as gauge, width, and material to the scale conditioning process controls 120. The coil start time is also input to the scale conditioning process controls 120 from the line dynamics operating system 112. The temperature sensing device 22 and surface analyzer 42 also provide inputs to the scale conditioning process controls 120. Other inputs to the scale conditioning process control system 120 include: storage tank level sensors (not shown), flow controllers 68, 70 and 72, individual nozzle flow sensors 87, 88, 89 and 90, storage tank temperature sensors 57, 59 and 61.

The scale conditioning process controls 120 provide outputs to control all aspects of the scale conditioning function. These aspects include the control of the fan 20 or other cooling control device to achieve the desired temperature of the strip as it enters the scale conditioning section 24 (which should be at least 450° F.), control of the selection of the vessel or vessels 56, 58 and 60 from which the scale conditioning solution is to be delivered, and rate of delivery from each vessel 56, 58 and 60, as will be described presently, and control of the nozzles 28, 30, 34 and 36 through metering valves 92, 94, 96 and 98 The flow of solution from each vessel 56, 58 and 60 is monitored by its respective flow monitors 68, 70 and 72. Thus, the flow of solution from the vessels 56, 58 and 60 can be separately monitored and controlled. This allows the vessels 56, 58 and 60 to be used in several ways. One way these vessels 56, 58 and 60 can be used is to store different solutions or different concentrations of solutions in each vessel, and the appropriate vessel 56, 58 or 60 selected. Another way that vessels 56, 58 and 60 can be used is to store various constituents of the final solution to be sprayed, for example, vessel 56 could contain a solution of a eutectic sodium/potassium hydroxide, vessel 58 could contain a solution of potassium permanganate which could be mixed selectively in mixer 76 to provide an added constituent when desired, and vessel 60 could contain water which also could be mixed in mixer 76 to provide the desired solution concentration. These are just a few examples of how the vessels 56, 58 and 60 can be used. Of course, if only a single solution of a single concentration is to used, only one vessel 56 need be provided, and of course more than three vessels 56, 58 and 60 can be provided.

The scale conditioning process controls 120 include a computer (not shown) in which is stored all of the parameters required for spraying the solution for each type of steel, based on composition, gauge, width, strip speed and any other relevant factors, such as time in furnace which might affect the condition of the scale on the surface of the strip. With these parameters already stored, the outputs from the line dynamic operating system 112 as inputs to the scale conditioning process control 120, the scale conditioning process control 120 adjusts the speed of the fan 20, to cool the strip to a temperature above which the anhydrous salt will melt and perform scale conditioning but below that at which the Leidenfrost effect appears, the selection of the nozzles 28, 30 and 34, and 36 if necessary, to be used to achieve the proper spray pattern, the selection of the vessel or vessels 56, 58 and 60 to achieve the programmed solution composition and concentration, and if necessary the time a new type of strip is entering the cooling section 18 and spray section 24. This allows a smooth operation of scale conditioning followed by the selected pickle in tanks 48, 50 and/or 52. The surface analyzer 42 continuously monitors the condition of the strip. If the surface condition falls outside predetermined parameters, the computer is programmed to adjust any of the variables to bring the surface condition back into the required parameters.

In operation, the backup spray nozzles 34 and 36 operate only when: 1) the individual nozzle flowmeters 87 and 88 indicate either reduced flow or no flow to any nozzle or, optionally, 2) when the surface analyzer 42 detects lack of scale conditioning on any portion of the surface of the strip. The primary detection system will be the individual nozzle flowmeters 87 and 88, with the optional surface analyzer 42 acting as a redundant checkpoint. The scale conditioning process control system 120 will turn on individual backup spray nozzles 34 and 36 as necessary corresponding to the inputs received from either the individual nozzle flowmeters 87 and 88 or the surface analyzer 42. Individual nozzle flowmeters 89 and 90 monitor flow to the individual nozzles 34 and 36 of the backup nozzle array. Indicated lack of flow to any nozzle will cause an alarm condition with annunciation and communication of such condition to the line dynamics operating system 112.

While the present invention has been illustrated by the description of the embodiments thereof, and while these embodiments have been described in considerable detail, it is not the intention to restrict or in any way limit the scope of the appended claims to such detail. Additional advantages and modifications may readily appear to those skilled in the art. Therefore, the invention, in its broadest aspects is not limited to the specific details, the representative apparatus, or the illustrative examples shown and described. Accordingly, departures may be made from such details without departing from the spirit or scope of the applicants' general inventive concept.

What is claimed is:

1. A system for conditioning scale on the surface of a metal object comprising:

at least one nozzle adapted to spray droplets of an aqueous caustic solution;

at least one reservoir for containing said aqueous caustic solution communicating with said at least one nozzle;

a driving mechanism positioned to move the metal object relative to said at least one nozzle;

a temperature-sensing device positioned to sense the temperature of the surface of said metal object prior to the metal object passing said at least one nozzle, a temperature modifier mechanism adjacent said temperature-sensing device, and a computer control unit in communication with the said temperature sensing device, the said temperature modifier mechanism, the said reservoir and the said nozzle to control said temperature modifier mechanism responsive to the sensed temperature of the surface of said metal object, said temperature modifier mechanism configured to responsively modify the temperature of the metal object until the sensed temperature is in a specified temperature range.

2. The system as defined in claim 1 wherein there is at least a second nozzle adapted to spray droplets of a solution communicating with said reservoir, and with said control mechanism.

3. The system as defined in claim 1 wherein the control mechanism includes flow control devices to control the flow individually from each reservoir to said nozzle.

4. The system as defined in claim 1 wherein said metal object is a metal strip.

5. The system as defined in claim 1 wherein an acid pickling station is provided.

6. The system as defined in claim 1 wherein there is a speed sensing device to sense the speed of said metal object, and said control mechanism is configured to vary the flow of said aqueous caustic solution responsive to the sensed speed of the metal object.

7. The system of claim 3 wherein:

a) the metal object has a composition and dimensions; and b) the control mechanism flow control devices control said flow responsive to at least one of the group consisting of the composition and the dimensions of said metal object.

8. The system of claim 6, wherein:

a) the metal object has a composition and dimensions; and b) the control mechanism flow control devices control said flow responsive to at least one of the group consisting of the composition and the dimensions of said metal object.

9. The system of claim 4 further comprising a surface condition analyzer in communication with said control mechanism and positioned to measure a degree of surface conditioning of said metal strip after said strip has been engaged by the spray droplets, wherein the control mechanism is further configured to control a flow rate of said aqueous caustic solution through said at least one nozzle responsive to the degree of surface conditioning measured by the surface analyzer.

10. The system of claim 1 further comprising a heating mechanism disposed to heat the surface of the metal object prior to the metal object passing said temperature-sensing device to a temperature above the melting point of the caustic composition contained in the aqueous solution.

11. A system for conditioning scale on the surface of a metal object comprising:

a first reservoir containing an aqueous caustic solution;

a second reservoir containing a second liquid solution;

at least one nozzle communicating with said first and second reservoirs and adapted to spray an atomized mist of a treatment mixture of said aqueous caustic solution and said second liquid solution and thereby cause the treatment mixture to engage the surface of the metal object, said treatment mixture having a concentration of the aqueous caustic solution and a concentration of the second liquid solution;

a driving mechanism positioned to move the metal object at a rate relative to said at least one nozzle and thereby passing said at least one nozzle; and a control mechanism in communication with said at least one nozzle, the control mechanism configured to control the flow rate of said treatment mixture through said at least one nozzle as an atomized mist engaging said metal object surface.

12. The system of claim 11, wherein the metal object has a surface temperature, further comprising:

a temperature-sensing device in communication with said control mechanism and positioned to sense the surface temperature of said metal object prior to the metal object passing said at least one nozzle;

a temperature control system in responsive communication with said control mechanism and positioned to increase or decrease the temperature of said metal object prior to the metal object passing said at least one nozzle;

wherein said control mechanism directs the temperature control system to increase or decrease the surface temperature of said metal object prior to the metal object surface engaging said atomized treatment mist responsive to the temperature-sensing device.

13. The system of claim 12, wherein the atomized treatment mixture comprises at least one salt having a melting point, and wherein the control mechanism is configured to direct the temperature control system to increase or decrease the surface temperature of said metal object prior to the metal object surface engaging said atomized treatment mist to a temperature above said salt melting point and below the temperature at which Leidenfrost effect appears on said metal object surface.

14. The system of claim 13 wherein the at least one nozzle is positioned and configured to cause the atomized treatment mixture mist to engage the surface of the metal object in an oxidizing atmosphere.

15. The system of claim 13, further comprising a surface analyzer in communication with said control mechanism and positioned to measure a degree of surface conditioning of said metal object surface after said surface has been engaged by said atomized treatment mist, wherein the control mechanism is further configured to control the flow rate of said treatment mixture through said at least one nozzle responsive to the degree of surface conditioning measured by the surface analyzer.

16. The system of claim 15, further comprising a speed sensing device in communication with said control mechanism and positioned to measure the rate at which said metal object surface passes said at least one nozzle, wherein the control mechanism is further configured to control the flow rate of said treatment mixture through said at least one nozzle responsive to the speed sensing device.

17. The system of claim 11, further comprising:

a flow monitor in series with the at least one nozzle configured to monitor the flow of the treatment mixture through said nozzle, said monitor communicating with the control mechanism; and at least a second nozzle in communication with said control mechanism and said first and second reservoirs and adapted to spray an atomized mist of a treatment mixture of said aqueous caustic solution and said second liquid solution and thereby cause the treatment mixture to engage the surface of the metal object;

wherein said control mechanism operates said second nozzle responsive to said flow monitor.

18. The system of claim 17 wherein the control mechanism is furthered configured to operate said second nozzle responsive to the degree of surface conditioning measured by the surface analyzer.

19. The system of claim 11, wherein the metal object has a composition, and wherein the control mechanism is further configured to vary the concentration of said first aqueous caustic solution and vary the concentration of the second liquid solution within said treatment mixture responsive to the composition of said metal object.

20. The system of claim 15, wherein the metal object has a composition and dimensions, and wherein the control mechanism is further configured to vary the concentration of said first aqueous caustic solution and vary the concentration of the second liquid solution within said treatment mixture responsive to at least one of the group consisting of the composition of said metal object, the dimensions of said metal object, and the degree of surface conditioning measured by the surface analyzer.

21. A system for conditioning scale on the surface of a metal object comprising:

first and second nozzles adapted to spray droplets of an aqueous caustic solution;

two reservoirs for containing said aqueous caustic solution communicating with said at least one nozzle;

a driving mechanism positioned to move the metal object relative to said at least one nozzle;

a temperature-sensing device positioned to sense the temperature of the surface of said metal object prior to the metal object passing said nozzles, a cooling mechanism adjacent said temperature-sensing device, a computer control unit in communication with the said temperature sensing device and the said cooling mechanism to control said cooling mechanism responsive to the sensed temperature of the surface of said metal object, said cooling mechanism configured to responsively modify the temperature of the metal object until the sensed temperature is in a specified temperature range;

wherein said first and second nozzles communicate with said reservoirs and said control mechanism.

22. A system for conditioning scale on the surface of a metal object comprising:

at least first and second nozzle adapted to spray droplets of an aqueous caustic solution;

at least one reservoir for containing said aqueous caustic solution communicating with said at least one nozzle;

a driving mechanism positioned to move the metal object relative to said at least one nozzle;

a temperature-sensing device positioned to sense the temperature of the surface of said metal object prior to the metal object passing said at least one nozzle, a cooling mechanism adjacent said temperature-sensing device; and a computer control unit in communication with the said temperature sensing device and the said cooling mechanism to control said cooling mechanism responsive to the sensed temperature of the surface of said metal object, said cooling mechanism configured to responsively modify the temperature of the metal object until the sensed temperature is in a specified temperature range;

wherein said metal object is a metal strip;

wherein there is at least one nozzle disposed on each side of said strip; and a surface coverage analyzer adjacent at least one nozzle on each side of said strip.

* * * * *

UNITED STATES PATENT AND TRADEMARK OFFICE

CERTIFICATE OF CORRECTION

PATENT NO. : 6,851,434 B2
DATED : February 8, 2005
INVENTOR(S) : John M. Cole et al.

It is certified that error appears in the above-identified patent and that said Letters Patent is hereby corrected as shown below:

Column 6,
Table I, third line from the bottom should be corrected to read as follows:
-- 60 w % @ 23 mis/min flow rate --

Column 7,
Table I-continuted, last word in last line of table should be corrected to read as follows:
-- eutectic. --

Signed and Sealed this

Fourteenth Day of June, 2005

JON W. DUDAS
*Director of the United States Patent and Trademark Office*